US005695687A

United States Patent [19]

Zelger et al.

[11] Patent Number: 5,695,687

[45] Date of Patent: Dec. 9, 1997

[54] ANHYDROUS FLUORESCENT WHITENING AGENT FORMULATION

[75] Inventors: Josef Zelger, Riehen, Switzerland; Serge Schroeder, Rosenau, France

[73] Assignee: Ciba Specialty Chemicals Corporation, Tarrytown, N.Y.

[21] Appl. No.: 641,863

[22] Filed: May 2, 1996

[30] Foreign Application Priority Data

May 6, 1995 [GB] United Kingdom ..... 9509291

[51] Int. Cl.[6] ..... C11D 3/42

[52] U.S. Cl. ..... 252/301.21; 510/324; 510/325; 510/516; 252/301.22; 252/301.23; 252/301.24; 252/301.25; 252/301.26; 252/301.27; 252/301.28; 252/301.29; 252/301.3; 252/301.31; 252/301.32; 252/301.35

[58] Field of Search ..... 510/324, 325, 510/516; 252/301.21, 301.22, 301.23, 301.24, 301.25, 301.26, 301.27, 301.28, 301.29, 301.3, 301.31, 301.32, 301.35

[56] References Cited

U.S. PATENT DOCUMENTS

| | | | |
|---|---|---|---|
| 3,754,964 | 8/1973 | Seuret et al. | 252/301.32 |
| 4,058,480 | 11/1977 | Lohmann et al. | 252/301.21 |
| 4,235,597 | 11/1980 | Reinert | 252/301.35 |
| 4,397,652 | 8/1983 | Neumann | 252/301.21 |
| 4,460,374 | 7/1984 | Abel et al. | 252/301.21 |
| 4,559,150 | 12/1985 | Becker et al. | 252/301.21 |
| 4,585,875 | 4/1986 | Heiss | 548/156 |
| 5,437,818 | 8/1995 | Ehlis et al. | 252/301.21 |

FOREIGN PATENT DOCUMENTS

| | | | |
|---|---|---|---|
| 0256343 | 2/1988 | European Pat. Off. . | |
| 0484095 | 5/1992 | European Pat. Off. . | |
| 0703293 | 3/1996 | European Pat. Off. . | |
| 703293 | 3/1996 | European Pat. Off. . | |
| 2076011 | 11/1981 | United Kingdom | 252/301.21 |
| 94/11485 | 5/1994 | WIPO . | |

OTHER PUBLICATIONS

Derwent Chem. Abstracts, 76–52289x (DD 120047) May 20, 1976.

*Primary Examiner*—Melissa Bonner
*Attorney, Agent, or Firm*—Kevin T. Mansfield

[57] ABSTRACT

The present invention provides an anhydrous fluorescent whitening agent formulation comprising:

a) 5 to 60, preferably 15 to 45% by weight of a fluorescent whitening agent or a mixture thereof;

b) 0 to 10, preferably 0 to 2% by weight of a stabiliser or a mixture thereof;

c) 0 to 10, preferably 0.5 to 2% by weight of a dispersant or a mixture thereof;

d) 0 to 10, preferably 0.5 to 2% by weight of an auxiliary or a mixture thereof; and e) an anhydrous dispersion medium or a mixture thereof to make up 100% by weight, each based on the total weight of the formulation.

The formulation is useful for the preparation of detergents.

18 Claims, No Drawings

ANHYDROUS FLUORESCENT WHITENING AGENT FORMULATION

The present invention relates to formulations of fluorescent whitening agents suitable for use in processes for the production of detergents with the exclusion of water.

For use in the production of detergents, there have recently been developed processes which are conducted in the absence of water. These processes use special mixing techniques and avoid conventional spray drying of aqueous slurries containing the detergent components.

In order to ensure that the fluorescent whitening agent of the detergent may be used in these new anhydrous processes, it is necessary to provide extrudable, sprayable or stirrable anhydrous formulations of the fluorescent whitening agent.

Surprisingly, it has now been found that specific anhydrous compositions of fluorescent whitening agent in an anhydrous dispersion medium, provide liquid, storage stable formulations which are eminently suitable for use in these new anhydrous processes, which ensure that the fluorescent whitening agent is homogeneously dispersed in the final detergent and which impart an improved aspect to the final detergent.

Accordingly, the present invention provides an anhydrous fluorescent whitening agent formulation comprising:

a) 5 to 60, preferably 15 to 45% by weight of a fluorescent whitening agent or a mixture thereof;
b) 0 to 10, preferably 0 to 2% by weight of a stabiliser or a mixture thereof;
c) 0 to 10, preferably 0.5 to 2% by weight of a dispersant or a mixture thereof;
d) 0 to 10, preferably 0.5 to 2% by weight of an auxiliary or a mixture thereof; and e) an anhydrous dispersion medium or a mixture thereof to make up 100% by weight, each based on the total weight of the formulation.

The anhydrous fluorescent whitening agent formulation according to the present invention is in a liquid form, that is in a physically mobile (non-solid) form which may range from a flowable paste, at one extreme, through suspension forms, to a free-flowing liquid at the other extreme. As already indicated, the formulation according to the present invention must be extrudable, sprayable or stirrable in order to be used in the recently-developed detergent production processes which are conducted in the absence of water.

The term "anhydrous" fluorescent whitening agent formulation, as used in the present specification and claims, denotes a fluorescent whitening agent formulation to which no water is deliberately added. Certain of the components of the formulation, however, in particular the fluorescent whitening agent, may contain a minor amount of water. As it is not always expedient to remove such adventitious water before making up the fluorescent whitening agent formulation of the invention, it is possible that the anhydrous fluorescent whitening agent formulation of the invention may contain a minor amount of water. Any minor amount of water present, however, should not exceed 5% by weight, and should preferably not exceed 2% by weight, based on the total weight of the formulation.

Preferred fluorescent whitening agents for use in the present invention are those having one of the formulae:

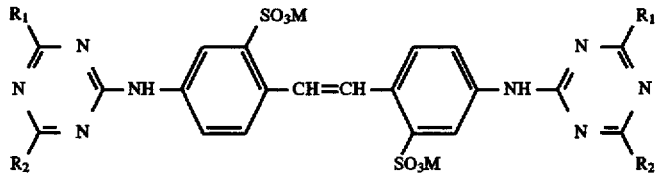

(1)

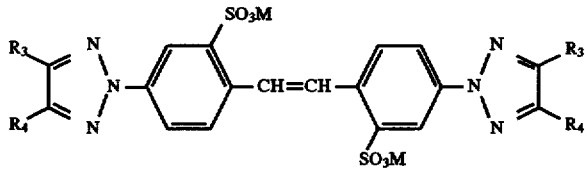

(2)

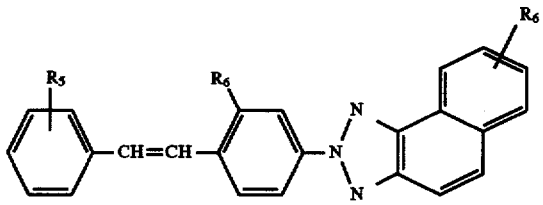

(3)

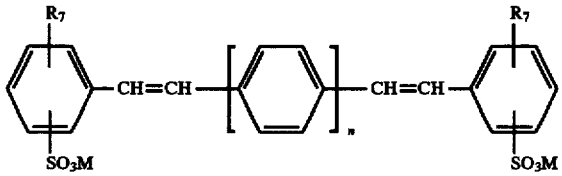

(4)

-continued

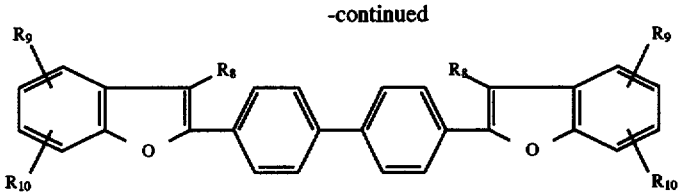

(5)

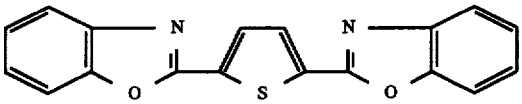

(6)

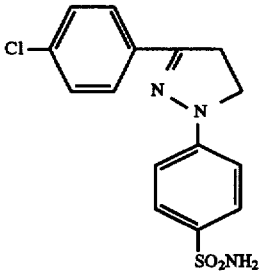

(7)

and

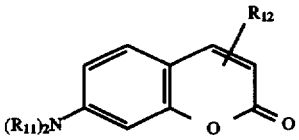

(8)

in which $R_1$ and $R_2$, independently, are OH, $NH_2$, O—$C_1$–$C_4$-alkyl, O-aryl, NH-$C_1$–$C_4$-alkyl, N($C_1$–$C_4$-alkyl)$_2$, N($C_1$–$C_4$-alkyl)($C_1$–$C_4$-hydroxyalkyl), N($C_1$–$C_4$-hydroxyalkyl)$_2$, NH-aryl, morpholino, S—$C_1$–$C_4$-alkyl (aryl), Cl or OH; $R_3$ and $R_4$, independently, are H, $C_1$–$C_4$-alkyl, phenyl or a group of formula:

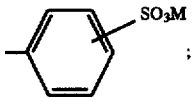

;

$R_5$ is H, Cl or $SO_3M$; $R_6$ is CN, $SO_3M$, S($C_1$–$C_4$-alkyl)$_2$ or S(aryl)$_2$; $R_7$ is H, $SO_3M$, O—$C_1$–$C_4$-alkyl, CN, Cl, COO—$C_1$–$C_4$-alkyl, or CON($C_1$–$C_4$-alkyl)$_2$; $R_8$ is H, Cl or $SO_3M$; $R_9$ and $R_{10}$, independently, are H, $C_1$–$C_4$-alkyl, $SO_3M$, Cl or O—$C_1$–$C_4$-alkyl; $R_{11}$ is H or $C_1$–$C_4$-alkyl; $R_{12}$ is H, $C_1$–$C_4$-alkyl, CN, Cl, COO—$C_1$–$C_4$-alkyl, CON($C_1$–$C_4$-alkyl)$_2$, aryl or O-aryl; M is H, Li, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted with a mixture of $C_1$–$C_4$-alkyl and $C_1$–$C_4$-hydroxyalkyl groups; and n is 0 or 1.

In the compounds of formulae (1) to (8), $C_1$–$C_4$-alkyl groups are, e.g., methyl, ethyl, n-propyl, isopropyl and n-butyl, especially methyl. Aryl groups are, e.g., naphthyl or, especially, phenyl.

Preferred compounds of formula (1) are those in which $R_1$ and $R_2$, independently, are O-methyl, O-phenyl, $NH_2$, NH-methyl, N(methyl)$_2$, N(methyl)(hydroxyethyl), NH-ethyl, N(hydroxyethyl)$_2$, NH-phenyl, morpholino, S-methyl(phenyl), Cl or OH.

Specific examples of preferred compounds of formula (1) are those having one of the formulae:

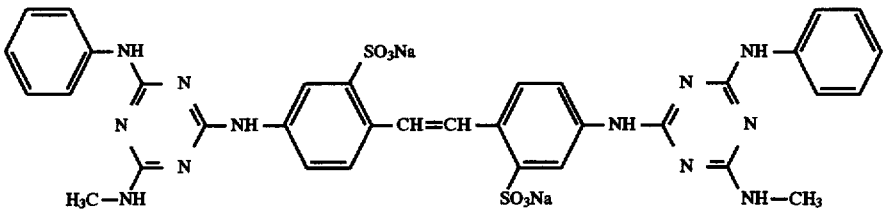

(9)

-continued
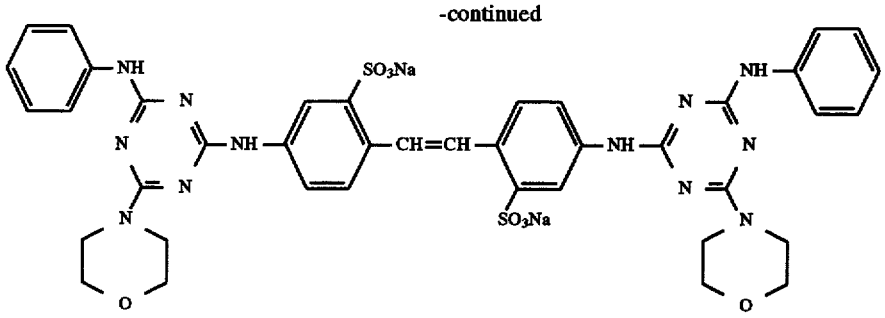
(10)
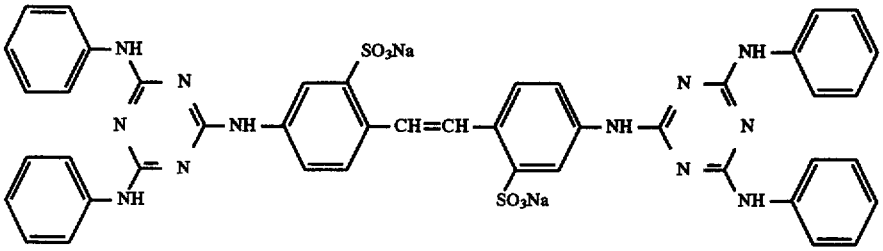
(11)
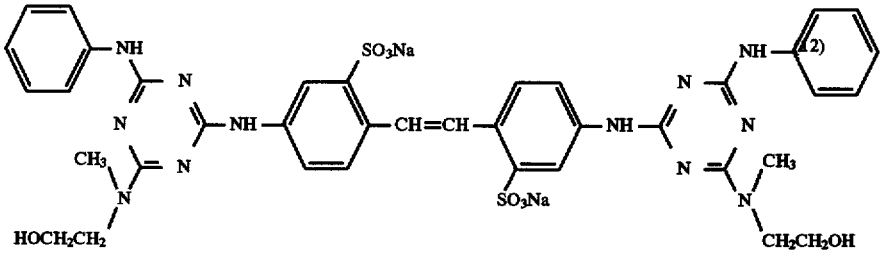
(12)
and
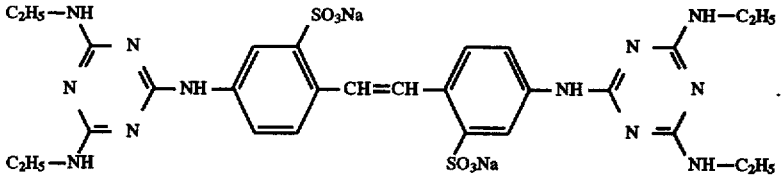
(13)
Specific preferred examples of compounds of formula (2) are those having one of the formulae:
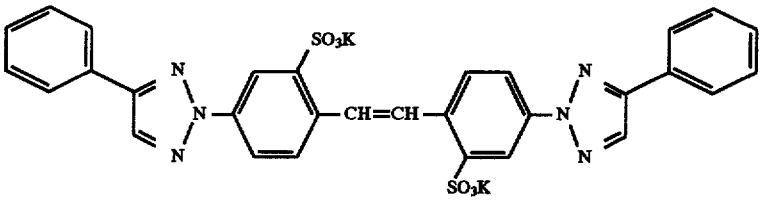
(14)
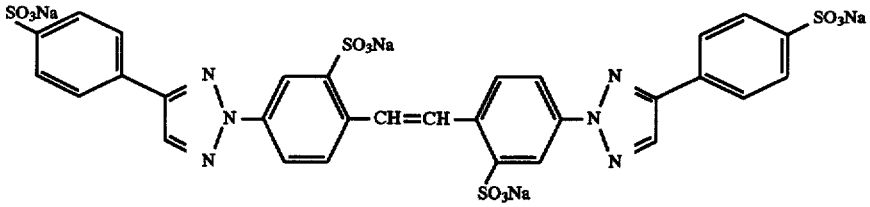
(15)
and -continued

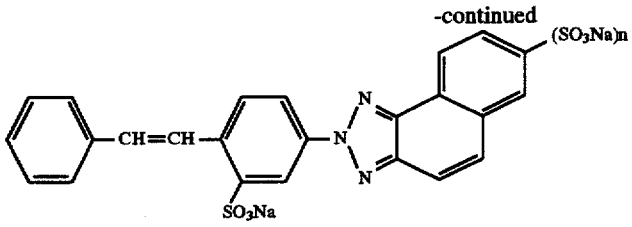

(16)

in which n has its previous significance.

Preferred examples of compounds of formula (4) are those having one of the formulae:

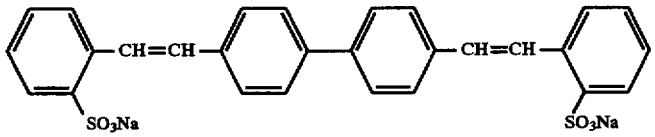

(17)

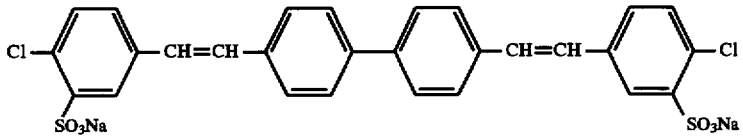

(18)

and

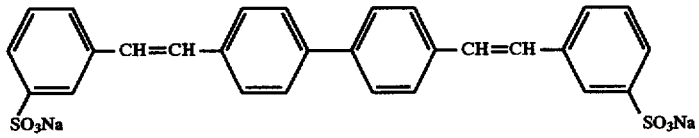

(19)

Especially preferred is the compound of formula (17), or a crystal modification thereof, as described in EP-A-0577557 and, in particular, the compound of formula (10).

Preferred examples of compounds of formula (5) are those having one of the formulae:

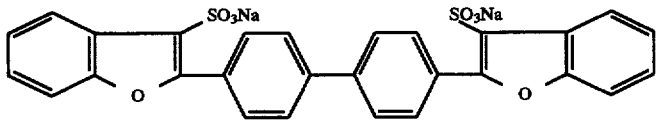

(20)

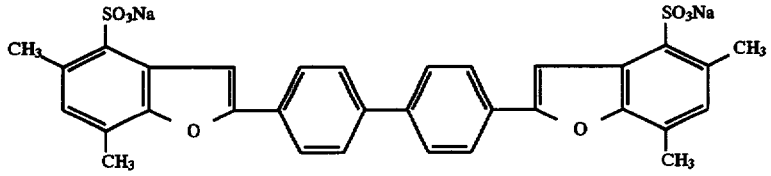

(21)

and

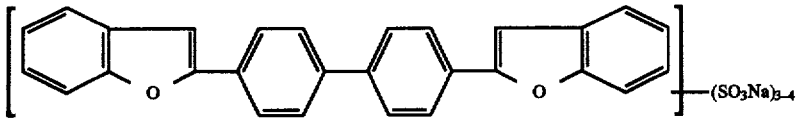

(22)

Also preferred is the use of mixtures of fluorescent whitening agents.

A preferred example of a compound of formula (8) is that having the formula:

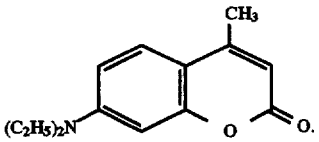

(23)

The compounds of formulae (1) to (8) are known and may be obtained by known methods.

The stabiliser for use in the present invention may be, any material which is effective in adjusting the flow properties of and/or inhibiting sedimentation from a non-aqueous system. Examples of such stabilisers include, e.g., kaolin, an Mg/Al silicate, especially bentonite, montmorillonite, a zeolite or a highly dispersed silicic acid.

Suitable dispersants may be those of the anionic or non-ionic type. Typical examples of such dispersants are alkylbenzenesulfonates, alkyl or alkenyl ether sulfonate salts, saturated or unsaturated fatty acids, alkyl or alkylene ether carboxylate salts, sulfonated fatty acid salts or esters, phosphate esters, polyoxyethylene alkyl or alkenyl ethers, polyoxyethylene alkyl vinyl ethers, polyoxypropylene alkyl or alkenyl ethers, polyoxybutylene alkyl or alkenyl ethers, higher fatty acid alkanolamides or alkylene oxide adducts, sucrose/fatty acid esters, fatty acid/glycol monoesters, alkylamine oxides and condensates of aromatic sulfonic acids with formaldehyde, as well as ligninsulfonates or mixtures of the above cited dispersants. Nonionic surfactants, such as polyoxyethylene alkyl or alkenyl ethers, polyoxyethylene alkyl vinyl ethers, polyoxypropylene alkyl or alkenyl ethers, polyoxybutylene alkyl or alkenyl ethers, higher fatty acid alkanolamides or alkylene oxide adducts, especially lower ethylene oxide adducts with fatty alcohols, are preferred.

Optional auxiliaries which may be present in the formulation of the present invention include anti-foam agents, alkaline agents, fabric softeners, anti-redeposition agents, antioxidants, auxiliary builders such as polyacrylic acid and fragrances, organic solvents such as glycols, e.g., ethylene glycol, glycol-$C_1$–$C_4$alkyl ethers or -esters.

The preferred anhydrous dispersion medium is an addition product of a $C_6$–$C_{18}$ fatty alcohol with 1–15 moles of ethylene oxide, an addition product of a $C_6$–$C_{18}$ fatty alcohol with 1–15 moles of propylene oxide or an addition product of a $C_6$–$C_{18}$ fatty alcohol with 1–15 moles of ethylene oxide and 1–15 moles of propylene oxide; or a mixture of such addition products. The fatty alcohol may be a linear or branched and may be a primary or secondary alcohol. Other preferred anhydrous dispersion media include a product made by condensing ethylene oxide with a reaction product of propylene oxide and ethylenediamine, an alkyl polyglycoside, a sugar ester, a long chain tert. phosphine oxide or a dialkyl sulfoxide.

The formulation of the present invention may be produced by mixing anhydrous fluorescent whitening agent, any stabiliser, optional dispersant and optional auxiliaries and dispersing medium, and homogenising the the mixture so obtained at room temperature or at elevated temperature, e.g. at 20°–100° C. Mixing is conveniently effected in a suitable mixer device. Homogenisation may optionally be completed by a subsequent grinding operation.

The desired concentration of fluorescent whitening agent in the formulation of the present invention may be adjusted by addition of anhydrous fluorescent whitening agent or dispersing medium to the mixture.

The formulation of the present invention is particularly suitable for incorporation into a detergent composition, conveniently by adding the required amount of the formulation of the present invention to a dry detergent composition and then homogenising the mixture so obtained.

The following Examples further illustrate the present invention.

EXAMPLES 1 and 2

The following components are mixed and homogenised:

37.3% by weight of a granulate containing 68% by weight of the compound of formula (10) as active substance;

61.7% by weight of a $C_{14}$–$C_{15}$ fatty alcohol ethoxylated with 4 moles of ethylene oxide; and 1.0% by weight of bentonite.

The white formulation so obtained remains liquid and forms no deposit after standing for 1 month at 5° C., at 25° C. or at 40° C. It has a pH value of 9.1 and a viscosity of 2800 cP at 22° C.

When the bentonite component is omitted from the formulation above, a white liquid product is obtained which remains liquid and forms no deposit after standing for 3 months at 25° C.

EXAMPLE 3

The following components are mixed and homogenised:

60.0% by weight of a powder containing 83% by weight of the compound of formula (10) as active substance; and 40.0% by weight of 2-methylpentandiol-2,4.

A white liquid product is obtained which remains liquid and forms no deposit after standing for 3 months at 25° C.

EXAMPLE 4 to 7

The following components are mixed and homogenised:

31.5% by weight of a powder containing 83% by weight of the compound of formula (10) as active substance; and 68.5% by weight of pentaerythritol propoxylated with 8.5 moles of propylene oxide.

A white liquid product is obtained which remains liquid and forms no deposit after standing for 1 week at 25° C.

Similar results are obtained when, in the above mixture, pentaerythritol propoxylated with 8.5 moles of propylene oxide is replaced by trimethylolpropane propoxylated with 3 moles of propylene oxide; a $C_{11}$–$C_{15}$ fatty amine alkoxylated with 40–50 moles of ethylene oxide and 30–40 moles of propylene oxide; or a $C_8$–$C_{10}$ fatty alcohol alkoxylated with ethylene oxide and propylene oxide.

EXAMPLES 8 to 10

The following components are mixed and homogenised:

15.0% by weight of a granulate containing 90% by weight of the compound of formula (17) as active substance; and 85.0% by weight of a $C_8$–$C_{11}$ fatty alcohol ethoxylated with 3 moles of ethylene oxide.

A white, slightly yellowish liquid product is obtained which remains liquid and forms no deposit after standing for 4 months at 25° C.

Similar results are obtained when, in the above mixture, the $C_8$–$C_{11}$ fatty alcohol ethoxylated with 3 moles of ethylene oxide is replaced by a $C_8$–$C_{11}$ fatty alcohol ethoxylated with 5 moles of ethylene oxide or a $C_8$–$C_{11}$ fatty alcohol ethoxylated with 6 moles of ethylene oxide.

EXAMPLES 11 to 13

The following components are mixed and homogenised:

15.0% by weight of a granulate containing 90% by weight of the compound of formula (17) as active substance; and 85.0% by weight of pentaerythritol ethoxylated with 15 moles of ethylene oxide.

A white liquid product is obtained which remains liquid and forms no deposit after standing for 1 week at 25° C.

Similar results are obtained when, in the above mixture, the pentaerythritol ethoxylated with 15 moles of ethylene oxide is replaced by the monomethyl ether of polyethylene glycol of molecular weight 350 or glycerine.

EXAMPLES 14 and 15

The following components are mixed and homogenised:

6.0% by weight of a granulate containing 90% by weight of the compound of formula (17) as active substance;

29.6% by weight of a powder containing 83% by weight of the compound of formula (10) as active substance; and 64.4% by weight of a $C_{12}$–$C_{14}$ fatty alcohol ethoxylated with 3 moles of ethylene oxide.

A white, slightly yellowish liquid product is obtained which remains liquid and forms no deposit after standing for 1 week at 25° C.

Similar results are obtained when, in the above mixture, the $C_{12}$–$C_{14}$ fatty alcohol ethoxylated with 3 moles of ethylene oxide is replaced with 2-methylpentandiol-2,4.

EXAMPLE 16

The following components are mixed and homogenised:

5.1% by weight of a granulate containing 90% by weight of the compound of formula (17) as active substance;

25.0% by weight of a powder containing 83% by weight of the compound of formula (10) as active substance;

64.4% by weight of a $C_{12}$–$C_{14}$ fatty alcohol ethoxylated with 3 moles of ethylene oxide; and 0.5% by weight of bentonite.

A white, slightly yellowish liquid product is obtained which remains liquid and forms no deposit after standing for 1 week at 25° C.

EXAMPLES 17 and 18

The following components are mixed and homogenised:

6.0% by weight of a granulate containing 90% by weight of the compound of formula (17) as active substance;

29.6% by weight of a powder containing 83% by weight of the compound of formula (10) as active substance; and 64.4% by weight of pentaerythritol propoxylated with 8.5 moles of propylene oxide.

A white liquid product is obtained which remains liquid and forms no deposit after standing for 1 week at 25° C.

Similar results are obtained when, in the above mixture, the pentaerythritol propoxylated with 8.5 moles of propylene oxide is replaced by trimethylolpropane propoxylated with 3 moles of propylene oxide.

EXAMPLE 19

The following components are mixed and homogenised:

3.3% by weight of a granulate containing 90% by weight of the compound of formula (17) as active substance;

32.5% by weight of a powder containing 83% by weight of the compound of formula (10) as active substance; and 64.2% of a $C_8$–$C_{10}$ fatty alcohol alkoxylated with ethylene oxide and propylene oxide.

A white liquid product is obtained which remains liquid and forms no deposit after standing for 1 week at 25° C.

EXAMPLE 20

The following components are mixed and homogenised:

10.0% by weight of a granulate containing 90% by weight of the compound of formula (17) as active substance;

25.3% by weight of a powder containing 83% by weight of the compound of formula (10) as active substance; and 64.7% of a $C_8$–$C_{10}$ fatty alcohol alkoxylated with ethylene oxide and propylene oxide.

A liquid product is obtained which remains liquid and forms no deposit after standing for 1 week at 25° C.

We claim:

1. An anhydrous liquid fluorescent whitening agent formulation consisting essentially of:

a) 15 to 60% by weight of a fluorescent whitening agent or a mixture thereof;

b) 0 to 10% by weight of a stabiliser or a mixture thereof;

c) 0 to 10% by weight of a dispersant or a mixture thereof;

d) 0 to 10% by weight of an auxiliary or a mixture thereof; and e) an anhydrous dispersion medium or a mixture thereof to make up 100% by weight, in which the anhydrous dispersion medium is selected from the group consisting of addition products of $C_6$–$C_{18}$ fatty alcohols with 1–15 moles of ethylene oxide, addition products of $C_6$–$C_{18}$ fatty alcohols with 1–15 moles of propylene oxide, addition products of $C_6$–$C_{18}$ fatty alcohols with 1–15 moles of ethylene oxide and 1–15 moles of propylene oxide, mixtures of such addition products, products made by condensing ethylene oxide with a reaction product of propylene oxide and ethylenediamine, alkyl polyglycosides, sugar esters, long chain tertiary phosphine oxides, dialkyl sulfoxides, 2-methyl-2,4-pentanediol, ethoxylated or propoxylated pentaerythritol, propoxylated trimethylolpropane, ethoxylated/propoxylated $C_{11}$–$C_{15}$ fatty amines and monomethylethers of PEG or glycerin, each based on the total weight of the formulation.

2. A formulation according to claim 1 comprising:

a) 15 to 45% by weight of a fluorescent whitening agent or a mixture thereof;

b) 0 to 2% by weight of a stabiliser or a mixture thereof;

c) 0.5 to 2% by weight of a dispersant or a mixture thereof;

d) 0.5 to 2% by weight of an auxiliary or a mixture thereof; and e) an anhydrous dispersion medium or a mixture thereof to make up 100% by weight, each based on the total weight of the formulation.

3. A formulation according to claim 1 in which the fluorescent whitening agent is one having one of the formulae:

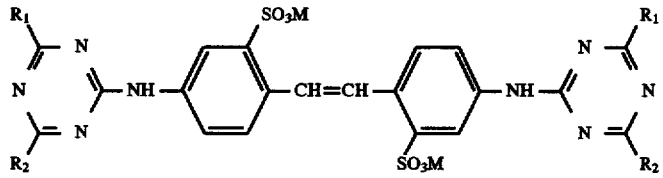

(1)

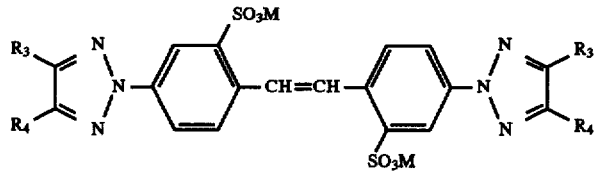

(2)

-continued (3)

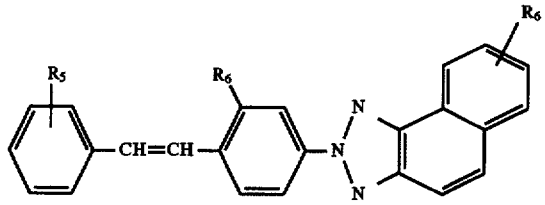

(4)

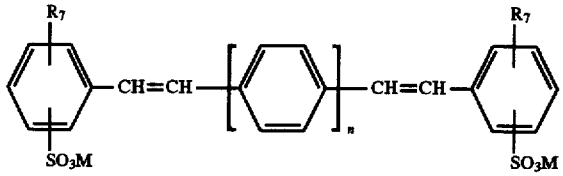

(5)

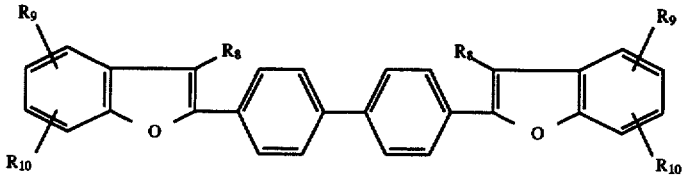

(6)

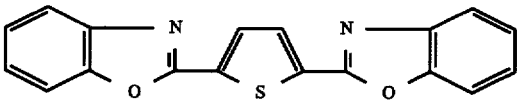

(7)

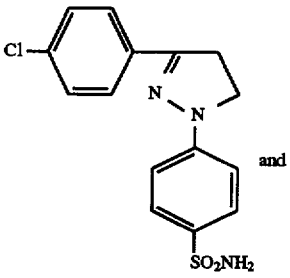

(8)

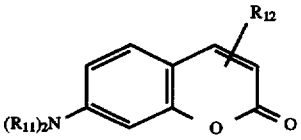

in which $R_1$ and $R_2$, independently, are OH, $NH_2$, O—$C_1$–$C_4$-alkyl, O-aryl, NH-$C_1$–$C_4$-alkyl, N($C_1$–$C_4$-alkyl)$_2$, N($C_1$–$C_4$-alkyl)($C_1$–$C_4$-hydroxyalkyl), N($C_1$–$C_4$-hydroxyalkyl)$_2$, NH-aryl, morpholino, S—$C_1$–$C_4$-alkyl (aryl), Cl or OH; $R_3$ and $R_4$, independently, are H, $C_1$–$C_4$-alkyl, phenyl or a group of formula:

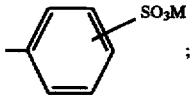

;

$R_5$ is H, Cl or $SO_3M$; $R_6$ is CN, $SO_3M$, S($C_1$–$C_4$-alkyl)$_2$ or S(aryl)$_2$; $R_7$ is H, $SO_3M$, O—$C_1$–$C_4$-alkyl, CN, Cl, COO—$C_1$–$C_4$-alkyl, or CON($C_1$–$C_4$-alkyl)$_2$; $R_8$ is H, Cl or $SO_3M$; $R_9$ and $R_{10}$, independently, are H, $C_1$–$C_4$-alkyl, $SO_3M$, Cl or O—$C_1$–$C_4$-alkyl; $R_{11}$ is H or $C_1$–$C_4$-alkyl; $R_{12}$ is H, $C_1$–$C_4$-alkyl, CN, Cl, COO—$C_1$–$C_4$-alkyl, CON($C_1$–$C_4$-alkyl)$_2$, aryl or O-aryl; M is H, Li, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted with a mixture of $C_1$–$C_4$-alkyl and $C_1$–$C_4$-hydroxyalkyl groups; and n is 0 or 1.

4. A formulation according to claim 3 in which the compound of formula (1) is one in which $R_1$ and $R_2$, independently, are are O-methyl, O-phenyl, $NH_2$, NH-methyl, N(methyl)$_2$, N(methyl)(hydroxyethyl), NH-ethyl, N(hydroxyethyl)$_2$, NH-phenyl, S-methyl (phenyl), morpholino, Cl or OH.

5. A formulation according to claim 4 in which the compound of formula (1) is one having one of the formulae:

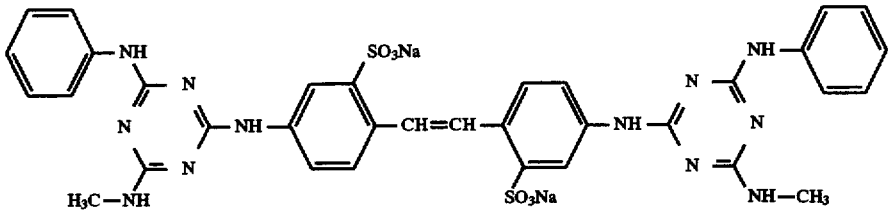
(9)
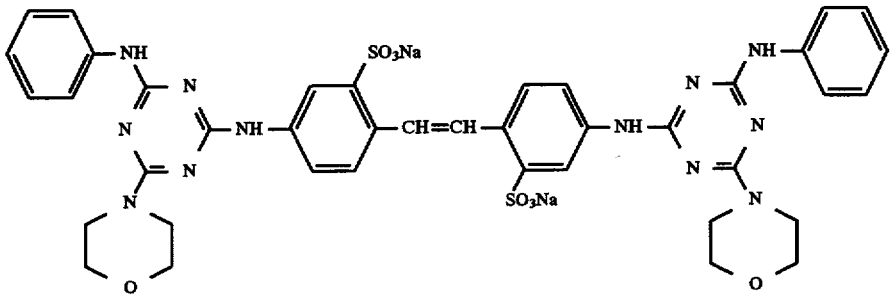
(10)
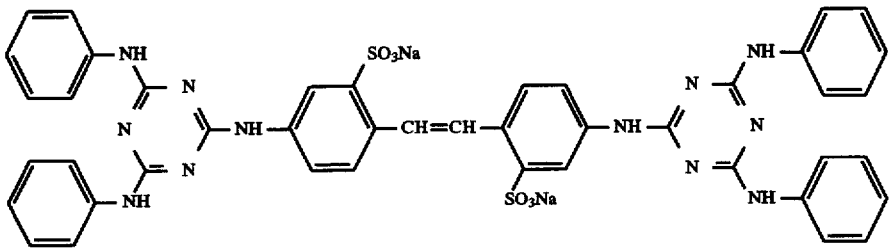
(11)
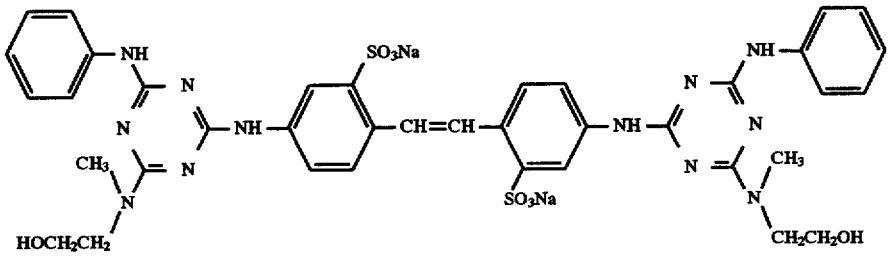
(12)
and
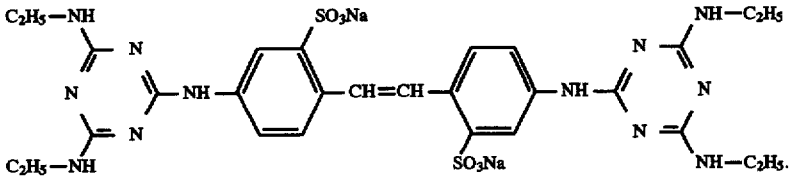
(13)
6. A formulation according to claim 3 in which a compound of formula (2) is one having one of the formulae:
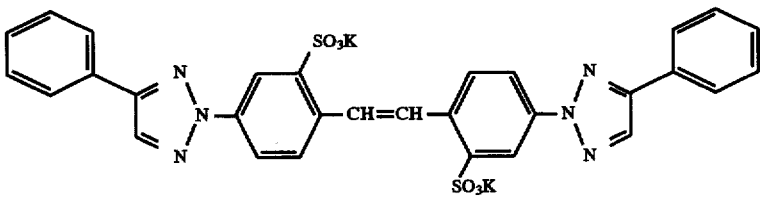
(14)

-continued
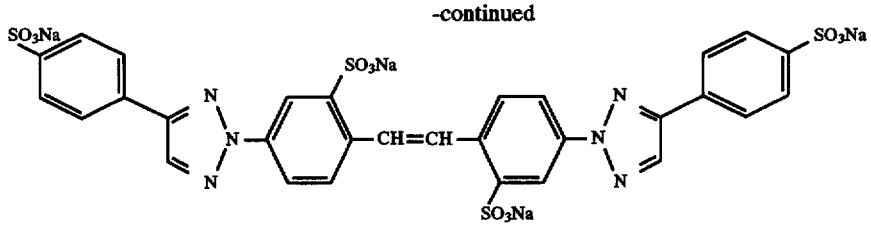
(15)
and
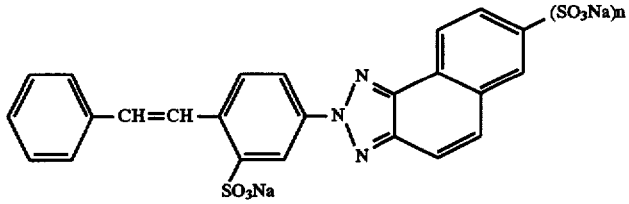
(16)
in which n is as defined in claim 3.
7. A formulation according to claim 3 in which a compound of formula (4) is one having one of the formulae:
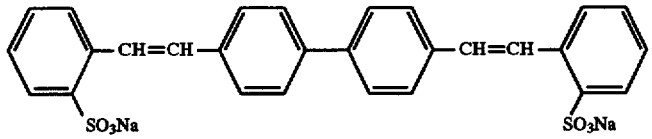
(17)
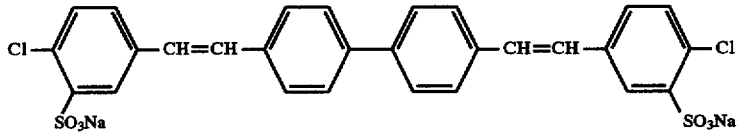
(18)
and
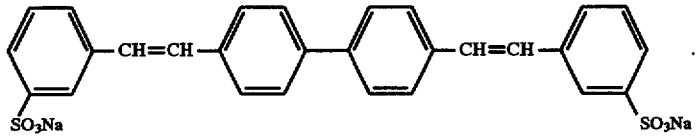
(19)
8. A formulation according to claim 3 in which a compound of formula (5) is one having one of the formulae:
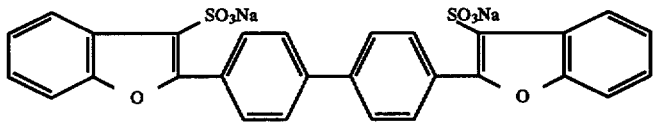
(20)
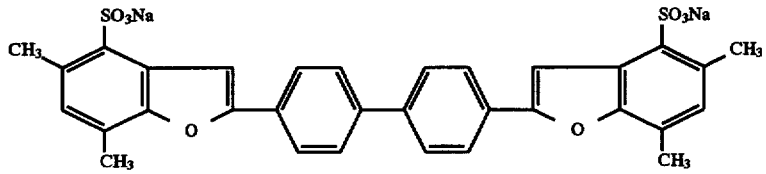
(21)
and
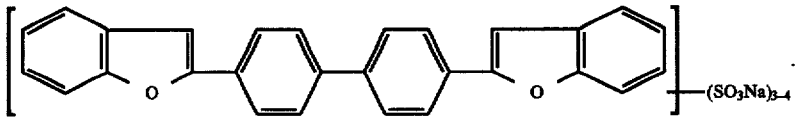
(22)
9. A formulation according to claim 3 in which a compound of formula (8) is that having the formula:

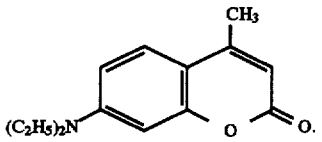

(23)

10. A formulation according to claim 7 in which the fluorescent whitening agent is the compound of formula (17) or a crystal modification thereof.

11. A formulation according to claim 5 in which the fluorescent whitening agent is the compound of formula (10).

12. A formulation according to claim 1 in which the stabiliser is kaolin, an Mg/Al silicate, montmorillonite, a zeolite or a highly dispersed silicic acid.

13. A formulation according to claim 12 in which the Mg/Al silicate is bentonite.

14. A formulation according to claim 1 in which the dispersant is of the non-ionic type.

15. A formulation according to claim 14 in which the nonionic dispersant is a polyoxyethylene alkyl or alkenyl ether, polyoxyethylene alkyl vinyl ether, polyoxypropylene alkyl or alkenyl ether, polyoxybutylene alkyl or alkenyl ether, higher fatty acid alkanolamide or alkylene oxide adduct.

16. A formulation according to claim 14 in which the nonionic dispersant is a lower ethylene oxide adduct with a fatty alcohol.

17. A formulation according to claim 1 in which the auxiliary is selected from the group consisting of an anti-foam agent, an alkaline agent, a fabric softener, an anti-redeposition agent, an antioxidant, an auxiliary builder, a fragrance and an organic solvent.

18. A method of producing a liquid formulation according to claim 1 comprising mixing an anhydrous fluorescent whitening agent, any stabiliser, optional dispersant and optional auxiliary and dispersing medium, and homogenising the the mixture so obtained at room temperature or at elevated temperature.

* * * * *